US006371892B1

(12) United States Patent
Dreissigacker et al.

(10) Patent No.: US 6,371,892 B1
(45) Date of Patent: Apr. 16, 2002

(54) EXERCISE MACHINE

(75) Inventors: Richard A. Dreissigacker, Morrisville; Peter D. Dreissigacker, Stowe; Jonathan V. Williams, Waterbury Center, all of VT (US)

(73) Assignee: Concept II, Inc., Morrisville, VT (US)

( * ) Notice: Subject to any disclaimer, the term of this patent is extended or adjusted under 35 U.S.C. 154(b) by 0 days.

(21) Appl. No.: 08/976,792

(22) Filed: Nov. 25, 1997

Related U.S. Application Data

(63) Continuation of application No. 08/584,823, filed on Jan. 11, 1996, now abandoned, which is a continuation of application No. 08/202,942, filed on Feb. 28, 1994, now abandoned.

(51) Int. Cl.[7] ..... A63B 69/06
(52) U.S. Cl. ..... 482/72; 74/594.6; 482/908
(58) Field of Search ..... 482/72, 73, 79, 482/80, 57, 908; 74/591.3–591.7

(56) References Cited

U.S. PATENT DOCUMENTS

| | | | | | |
|---|---|---|---|---|---|
| 562,546 | A | * | 6/1896 | Law | 74/594.6 |
| 642,874 | A | * | 2/1900 | Park | 74/594.6 |
| 1,950,896 | A | * | 3/1934 | Luzzi | 482/72 |
| 2,069,454 | A | * | 2/1937 | Lofquist et al. | 74/594.4 |
| 2,733,065 | A | * | 1/1956 | Barkschat | 482/79 |
| 3,472,508 | A | * | 10/1969 | Baker | 482/79 |
| 3,802,700 | A | * | 4/1974 | Mayo | 601/27 |
| 3,960,027 | A | * | 6/1976 | Magnuson | 74/594.6 |
| 3,963,251 | A | * | 6/1976 | Miano | 74/594.6 |
| 4,263,902 | A | * | 4/1981 | Dieterich | 601/27 |
| 4,337,939 | A | * | 7/1982 | Hoyle et al. | 482/79 |
| 4,346,886 | A | | 8/1982 | Cox et al. | 272/72 |
| 4,378,112 | A | | 3/1983 | Goldstein | |
| 4,396,188 | A | | 8/1983 | Dreissigacker et al. | 272/72 |
| 4,875,674 | A | | 10/1989 | Dreissigacker et al. | 272/72 |
| 4,880,224 | A | * | 11/1989 | Jonas et al. | 272/72 |
| 4,884,800 | A | | 12/1989 | Duke | 272/72 |
| 4,997,181 | A | | 3/1991 | Lo | 272/72 |
| 5,013,033 | A | | 5/1991 | Watterson | |
| 5,072,929 | A | | 12/1991 | Peterson et al. | 272/72 |
| 5,094,446 | A | | 3/1992 | Wiedner | 272/72 |
| 5,110,118 | A | | 5/1992 | Winey | 482/73 |

OTHER PUBLICATIONS

The Concept II Rowing Ergometer Brochure, 1990.
Concept II Model C Rowing Ergometer Brochure, 1993.

* cited by examiner

*Primary Examiner*—Stephen R. Crow
(74) *Attorney, Agent, or Firm*—Fish & Richardson P.C.

(57) ABSTRACT

Exercising is made more comfortable and effective by providing a foot rest that has a front end which holds the ball of the user's foot fixed and a back end that both cradles the user's heel and allows the user to pivot his heel around the ball of his foot in a natural manner. The frame of the machine can be easily and repeatedly taken apart and put back together because it has two arms which mate at a connector that can be mated and unmated by simple pivoting of the two arms.

18 Claims, 9 Drawing Sheets

EXERCISE MACHINE

This is a continuation of application Ser. No. 08/584,823, filed Jan. 11, 1996, now abandoned, which is a continuation of prior application Ser. No. 08/202,942, filed on Feb. 28, 1994, abandoned.

BACKGROUND OF THE INVENTION

This invention relates to exercise machines.

The frames of some kinds of exercise machines, e.g., a rowing machine, are made of long, heavy rigid metal pieces which are strong enough to support a seated user and to withstand the forces and motion which occur during exercise. Places are provided on the frame for the user to rest his feet.

SUMMARY OF THE INVENTION

In the invention, exercising is made more comfortable and effective by providing a foot rest that has a front end which holds the ball of the user's foot fixed and a back end that both cradles the user's heel and allows the user to pivot his heel around the ball of his foot in a natural manner. The frame of the machine can be easily and repeatedly taken apart and put back together because it has two arms which mate at a connector that can be mated and unmated by simple pivoting of the two arms.

Thus, in general, in one aspect, rowing is made more comfortable and effective by providing a rowing machine in which the footrest has a front end for holding the foot portion of a rower's foot substantially fixed relative to the frame of the machine, and a back end for cradling the heel of the rower's foot. The back end is movable relative to the front end to permit the rower to pivot the heel of his foot relative to the front portion of his foot.

Implementations of the invention may include the following features. The back end may be a flexible strap that slides in a channel in the front end to permit adjustment for foot length. The adjustment may be enabled by a post in the front end and a series of holes along the length of the strap. The hole fit over the post to fix the position of the back end relative to the front end.

The back end of the foot rest may include a cross strap which resists backward sliding of the rower's foot and which defines a window for receiving the heel of the rower's shoe. The back end may provide some degree of resistance to pivoting of the rower's heel. The back end may cradle the rower's heel against lateral movement.

In general, in another aspect, the invention features an exercise machine which is easily stored and set up for use, the machine frame having two beams which mate at a joint configured to allow the two beams to be quickly and repeatedly put together and taken apart. Each beam is supported at an end opposite the joint, and the unsupported end of each beam tends to fall, by force of gravity, about the supported end when the beams are not mated. The joint includes mating mechanical elements on the beams (e.g., a pair of pins and a pair of hooks) which cooperate when mated to lock the unsupported ends to each other to the tendency of the beams to fall. The joint is unlocked by reverse pivoting at least one of the beams about its supported end.

Other advantages and features will become apparent from the following description and from the claims.

DESCRIPTION

FIG. 1 is a perspective view of a rowing machine.

FIGS. 2A, 2B, 2C, and 2D are side views of stages of a rowing cycle.

Figure 7A:
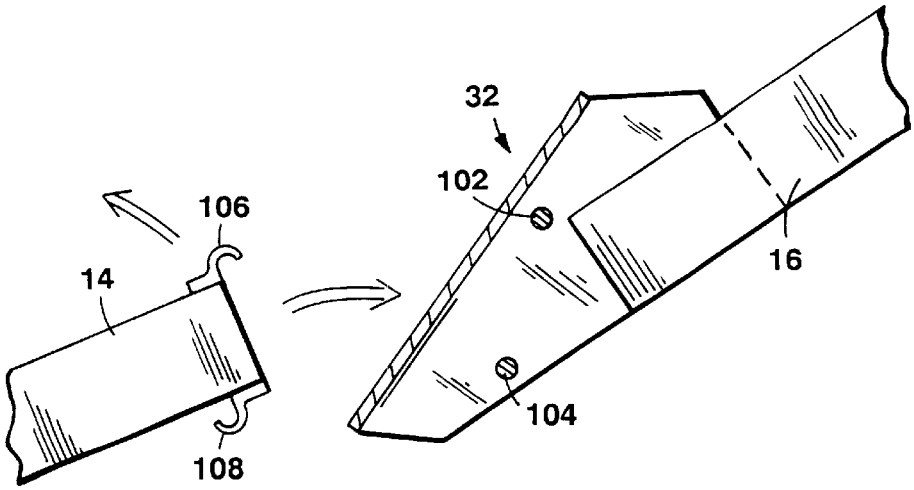
Figure 7B:
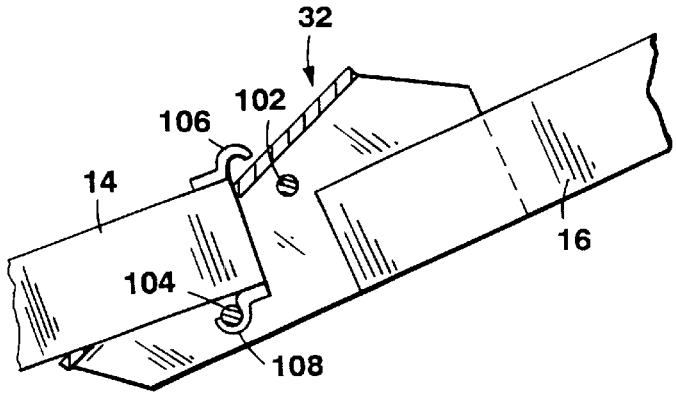
Figure 7C:
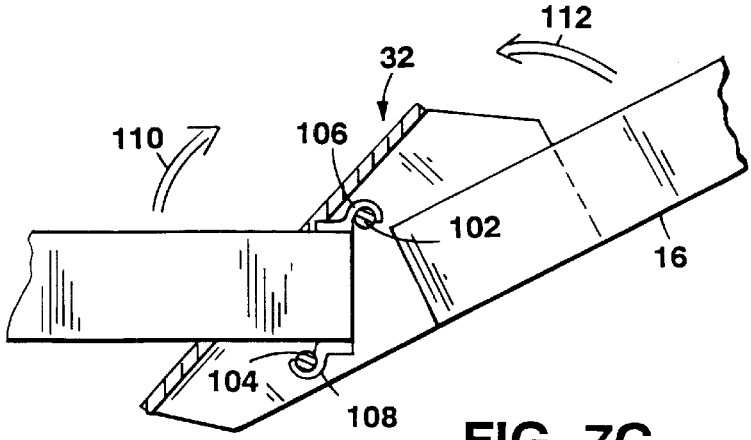

FIGS. 7A, 7B, and 7C are diagrammatic side views of a joint structure.

Figure 8:
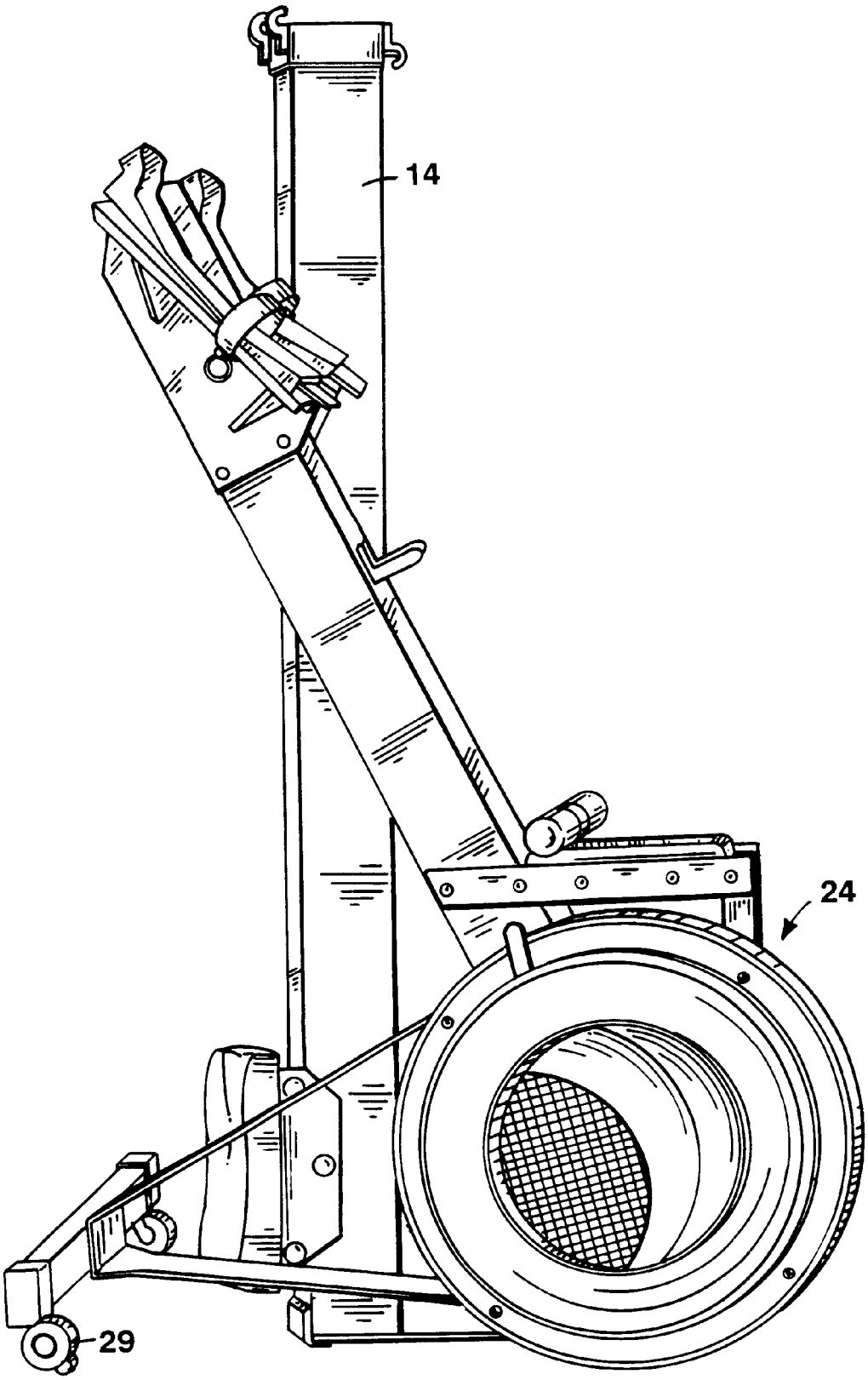

FIG. 8 is a perspective view of the rowing machine, disassembled.

Figure 1:
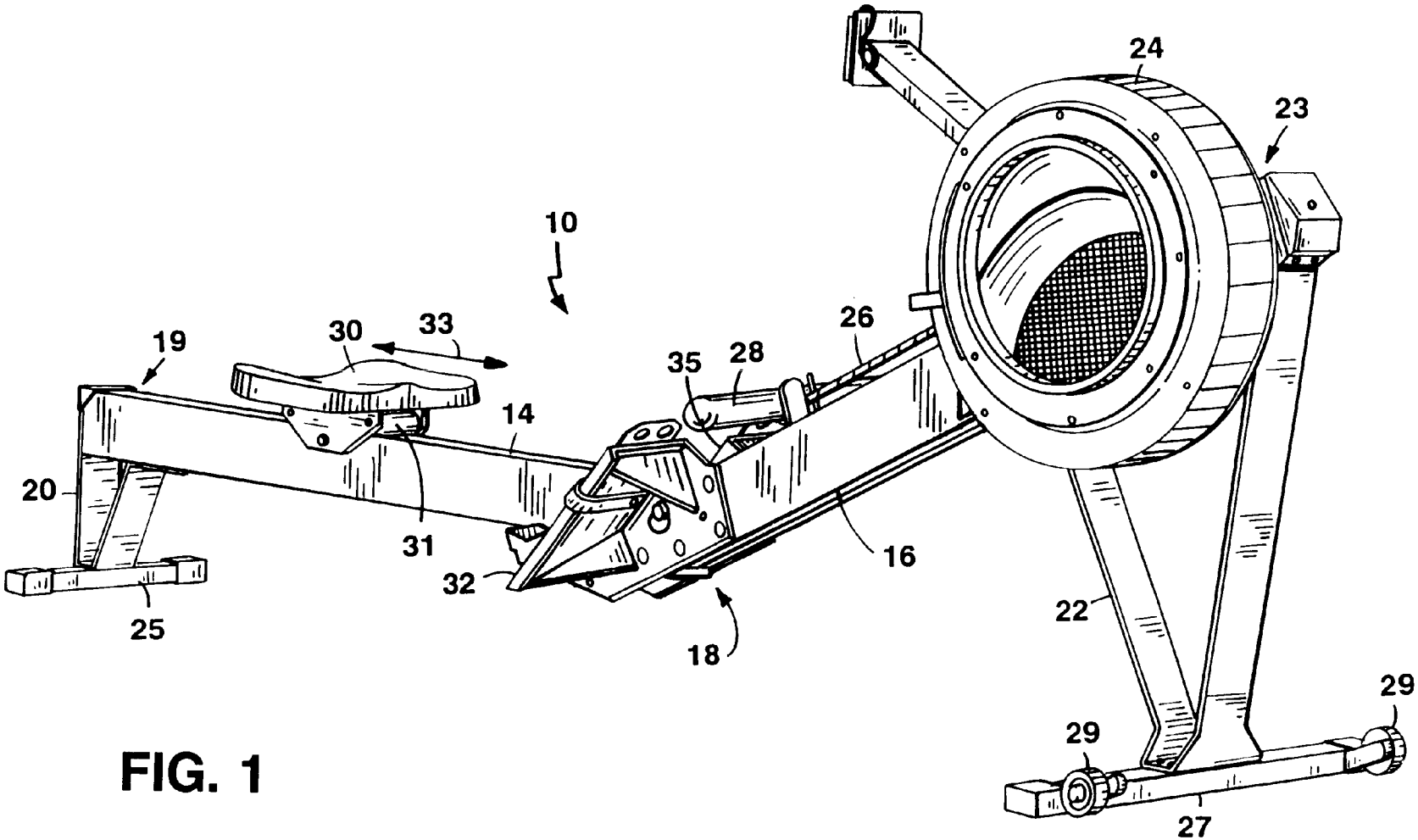

A rowing machine 10 (FIG. 1) has a two-piece frame including a hollow, extruded aluminum monorail beam 14 and a hollow angled extruded aluminum extension arm 16. The beam and the arm are mated at an unsupported quick-release joint 18. The other end 19 of the beam is supported by a bracket 20, and the other end 23 of the angled arm 16 is supported by a bracket 22. A flywheel/fan mechanism 24 is mounted near the bracket end of the angled arm. Cross bars 25, 27, perpendicular to the beams, provide lateral stability. Casters 29 on the front cross bar 27 allow the flywheel section of the rowing machine to be rolled, when the machine is disassembled, for easy transport. A wooden rowing handle 28 with molded rubber grips is connected to the flywheel/fan mechanism via a drive cable 26. A contoured rowing seat 30 glides (arrows 33) on rollers 31 along the monorail beam 14. A pair of foot rests 32, 35 are attached on either side of the angled arm near the quick-release joint.

Figure 2A:
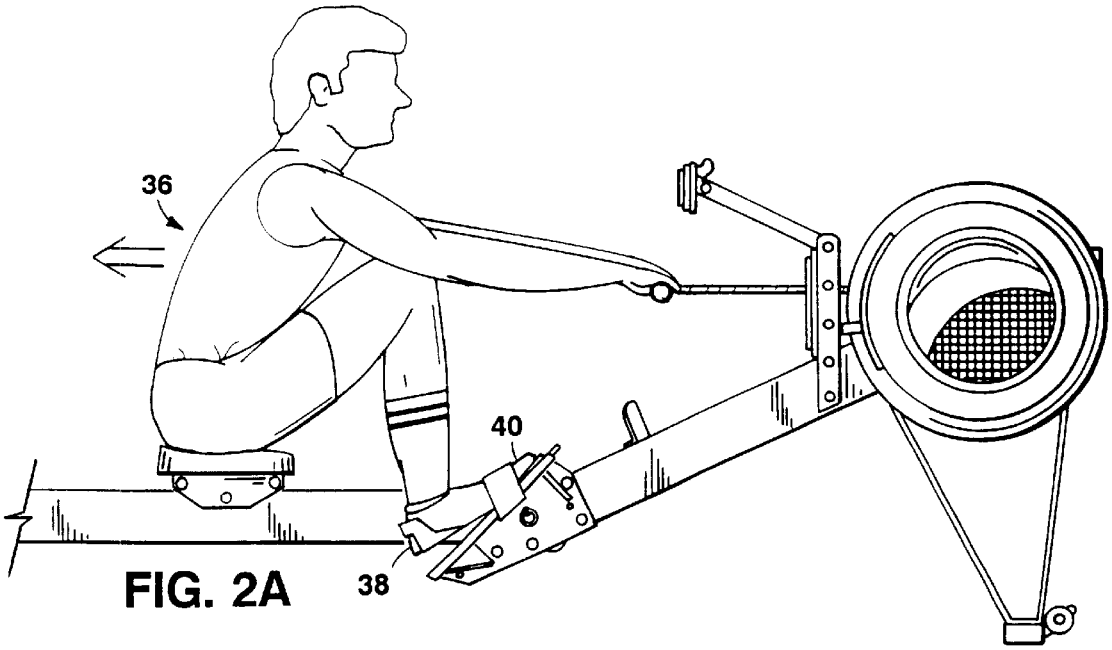
Figure 2B:
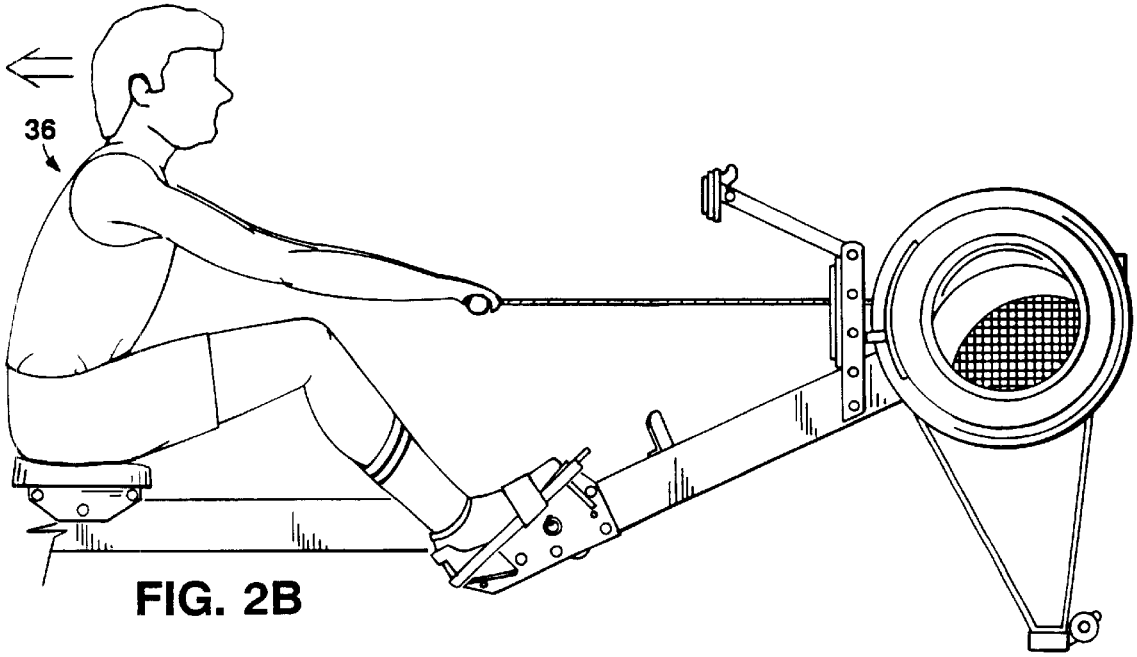
Figure 2C:
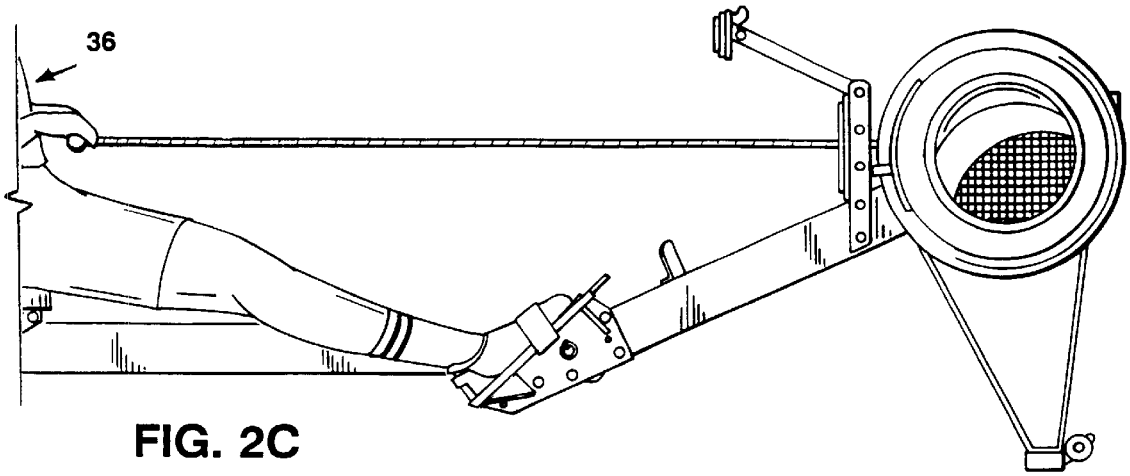
Figure 2D:
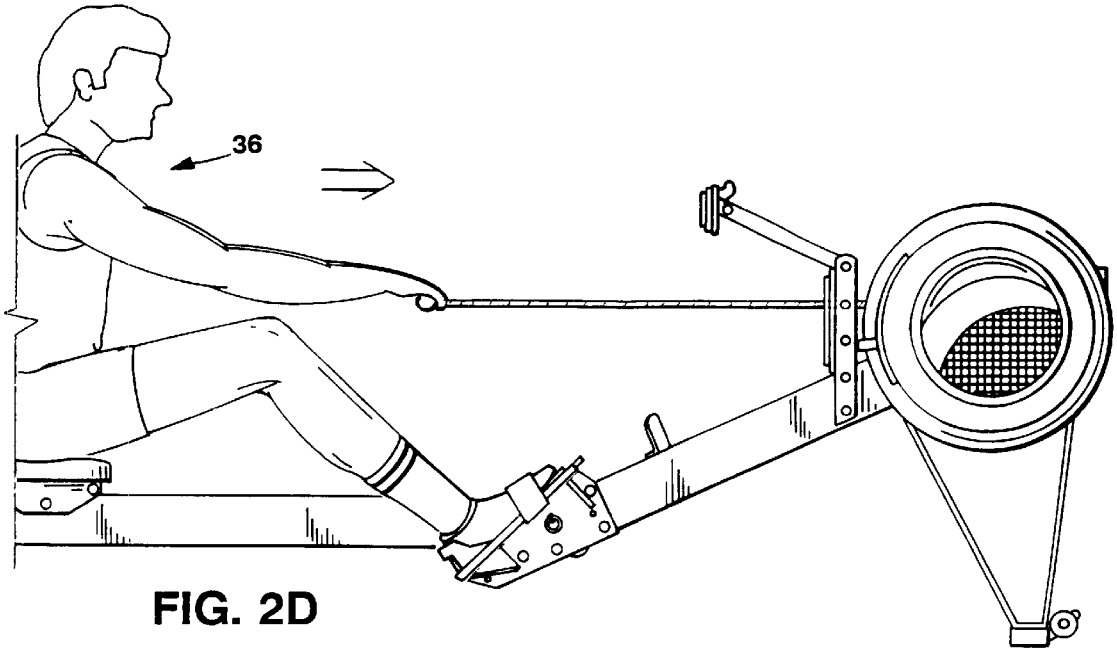

The rowing cycle begins (FIG. 2A) with the rower 36 in the catch position. The rower then drives backward by extending his legs and swinging his torso through the vertical position (FIG. 2B), and finishes the stroke by drawing the handle into his abdomen (FIG. 2C). The rower then uses his legs to draw his body back (FIG. 2D), recovering to the catch position.

During the drive portion of the cycle the ball of the foot is held fixed relative to the frame of the rowing machine. During recovery the foot is prevented from lifting away from, or sliding laterally relative to, the foot rests.

Figure 3:
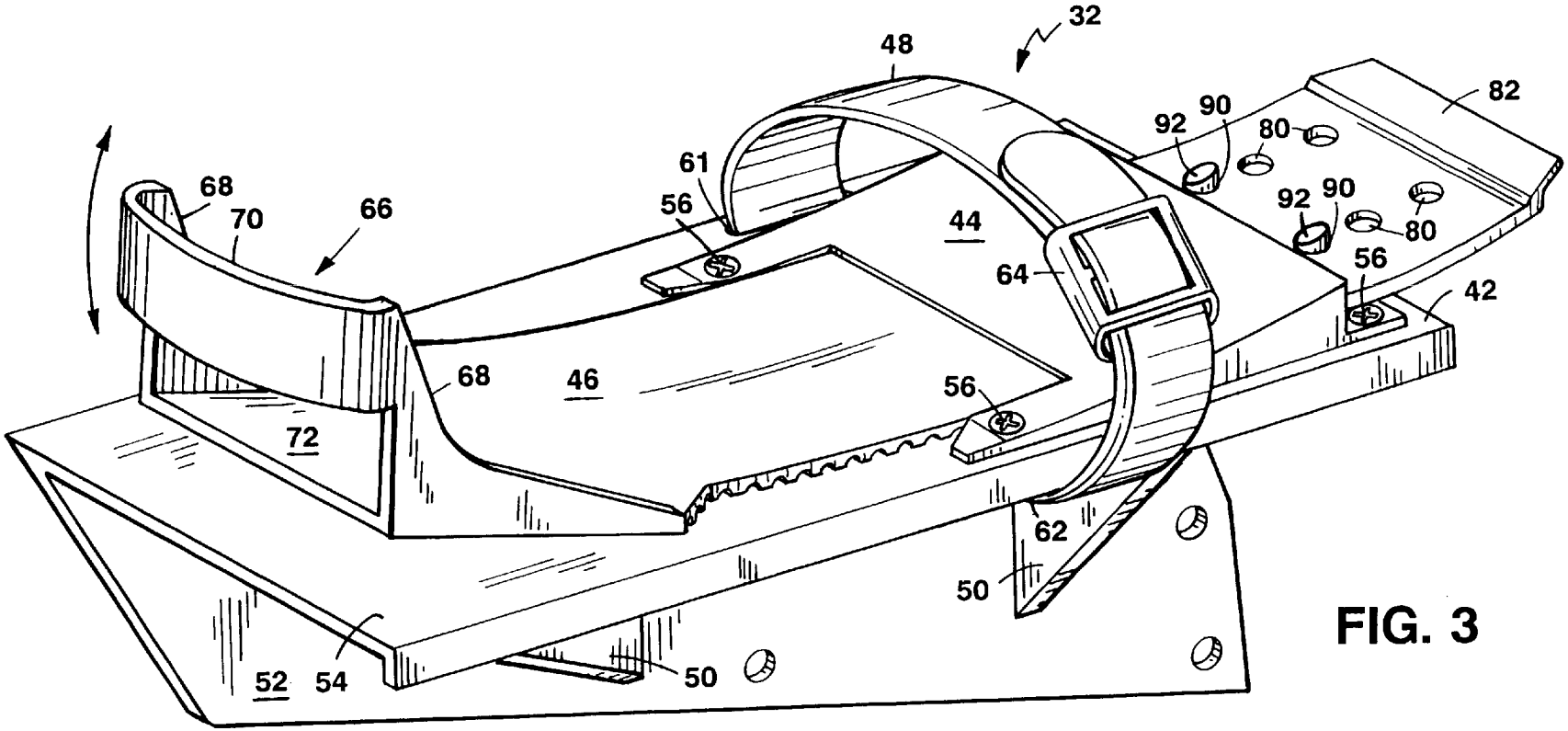
FIG. 3 is a perspective view of a right foot rest.
Figure 5A:
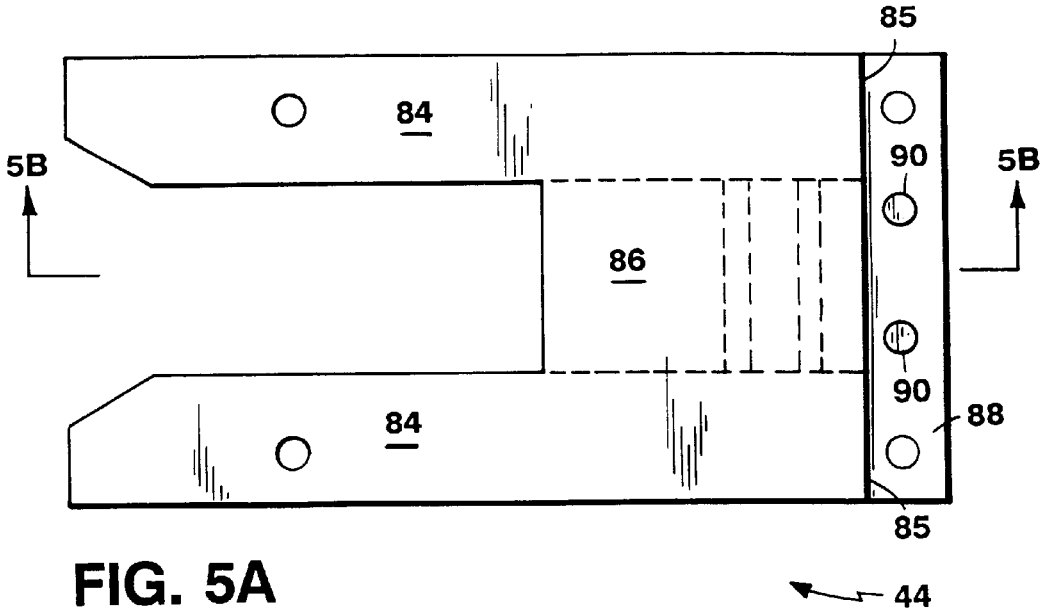
FIG. 5A is a plan view of a toe block.
Figure 5B:
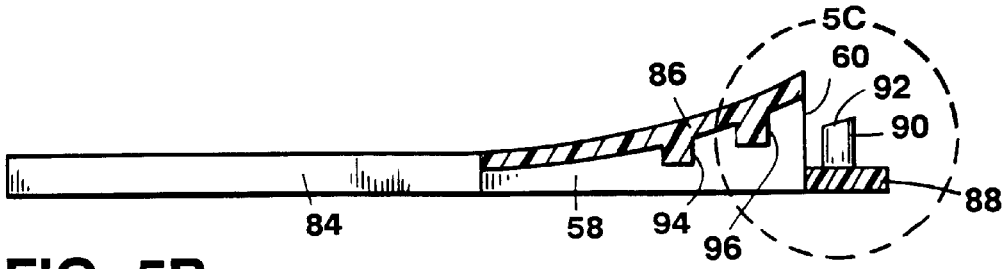
FIG. 5B is a sectional view at 5B—5B in FIG. 5A.

Each foot rest 32 (FIG. 3) includes a support platform 42, a toe block 44, a heel strap 46, and an adjustable anchor strap 48. The support platform is bent from 8 gauge aluminum or 13 gauge steel, with gussets 50 welded between the two sides 52, 54 of the angle iron to brace them. The toe block is fastened to the support platform with nuts and screws 56. The heel strap passes through a channel 58 (FIGS. 5A, 5B, and 5C) under the toe block and out a slot 60 in the front of the toe block. Referring again to FIG. 3, the anchor strap passes through a hole 61 on the inside side of the support platform and surrounds the toe block. It fastens with a buckle 64, and holds the ball of the rower's foot securely against the toe block.

Figure 4A:
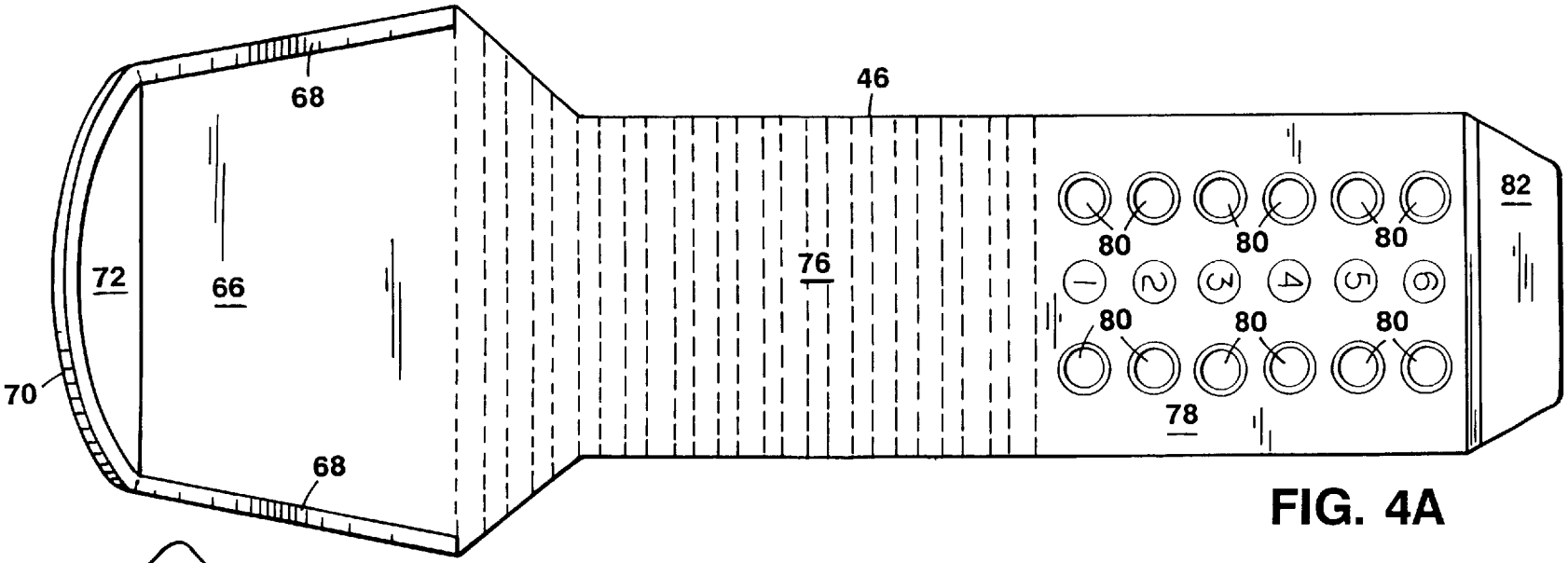
FIGS. 4A and 4B are plan and side elevational views, respectively, of a heel strap.
Figure 4B:
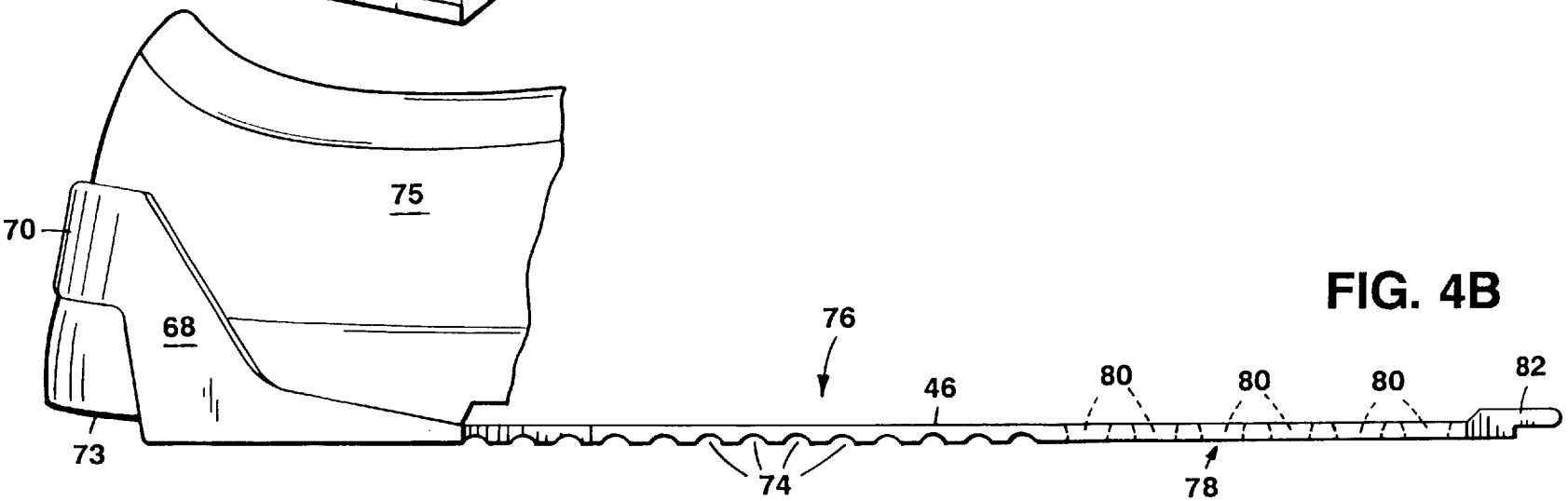

The heel strap (FIGS. 4A, 4B) is made from a single piece of semi-flexible, injection molded thermoplastic elastomer such as Santoprene. It has a heel cup 66, to cradle the rower's heel, formed by a pair of risers 68 and a curved cross strap 70 connected between the risers. A window 72 is left under the cross strap through which the heel 73 of the rower's shoe 75 protrudes.

A series of cross channels 74 across the width of the bottom of the heel strap, combined with the flexibility of the plastic, allow the heel strap to flex in mid-region 76.

Referring again to FIG. 2A, in the catch position, the rower's heel 38 tends to "lift" and pivot relative to the ball of the foot 40. As the rower moves into the catch position and his heel rises from the support platform, the heel of the rower's shoe catches the bottom surface of the cross strap 70 and carries the heel cup with it. Thus, because the heel strap flexes, the rower's heel is free to rotate relative to the ball of the foot.

Because the heel strap rides with the rower's shoe, it also provides a small downward restraining force. The restraining force adds to lateral stability of the heel strap and prevents the rower's foot from rotating out from under the anchor strap 48. It also gives the rower a sense that his foot is securely held by the foot rest, and helps to simulate the "feel" of the foot restraints found in most rowing shells.

The toe block 44 (FIGS. 5A and 5B) is made from a single piece of injection molded plastic such as Polycarbonate. It has a pair of legs 84 which have upper surfaces that curve up at the front, and a toe-rest 86 which bridges the legs. The upward curve is such that, as the rower pushes against the toe-rest to drive himself backward, he applies force more nearly perpendicularly to the foot rest than he would if the toe-rest were not curved, which makes the drive portion of the rowing cycle more efficient. The upward curve also helps to prevent the rower's foot from sliding forward under the anchor strap 48 so that the ball of the foot stays fixed relative to the frame.

The legs 84 and toe rest 86 define the channel 58 through which the heel strap passes. A post base 88 spans the channel at the bottom front of the toe block, blocking a portion of the channel. The front ends 85 of the legs 84, the bottom of the toe rest, and the post base define the slot 60 through which the heel strap passes to allow adjustment of the length of the foot rest.

A pair of 0.375 inch diameter posts 90 extend perpendicularly from the post base in front of the slot 60. The toe portion 78 (FIG. 4B) of the heel strap has six evenly spaced pairs of .400 inch diameter adjusting holes 80 which fit over the posts to prevent the heel strap from sliding. The position of the heel cup, relative to the toe block, is adjusted by lifting the toe portion of the heel strap clear of the posts, sliding the heel strap one way or the other, then pressing the toe portion down so that the posts extend through a different pair of adjusting holes. The top surfaces 92 of the posts are angled (FIG. 5B) to make it easy to adjust the heel strap.

Figure 5C:
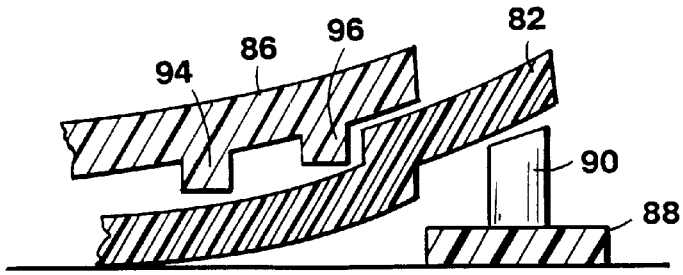
FIG. 5C is an enlarged sectional side view of a portion of the toe block (indicated by a circle in FIG. 5B).

The toe rest 86 has a pair of ribs 94, 96 on its bottom surface which strengthen the toe rest. The toe portion of the heel strap has a tapered overlap portion 82 which extends forward from its upper surface. The overlap portion butts up against the front rib 96, when the heel strap is fully extended, to prevent the heel strap from being pulled out from under the toe block (FIG. 5C).

Figure 6A:
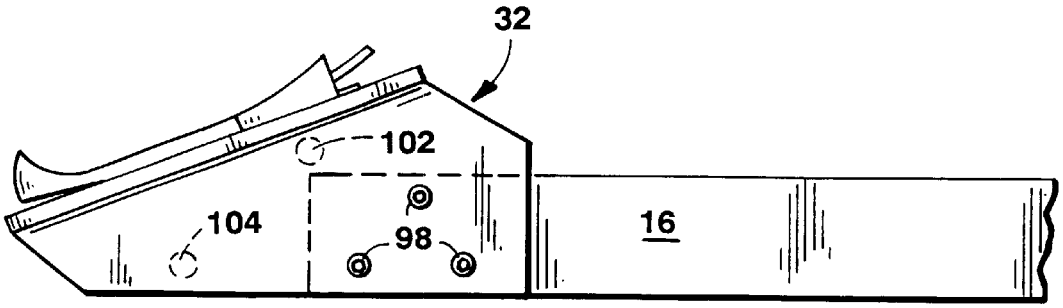
FIGS. 6A and 6B are side elevational and top views, respectively, of left and right foot rests attached to an extension arm.
Figure 6B:
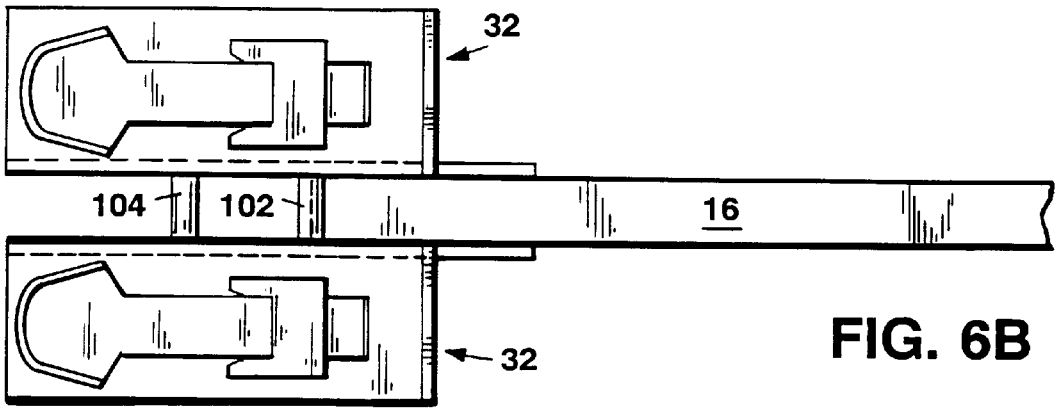

The foot rests 32 are attached (FIGS. 6A and 6B) to the frame at the joint end of the extension arm 16 with bolts 98. A pair of joint pins 102, 104 (FIGS. 7A, 7B, 7C) are bolted through the foot restraints, and a pair of hooks 106, 108 are bolted to the upper and lower surfaces of the monorail beam 14, facing in opposite directions.

The monorail beam and the angle arm are mated by inserting the joint end of the monorail between the foot restraints, hooking the lower joint pin 104 with the lower hook 108, and rotating the monorail beam relative to the extension arm until the upper hook 106 engages the upper joint pin 102. Because the joint is unsupported, the two beams tend to rotate towards each other about their respective support brackets 20, 22 as shown by arrows 110, 112. The joint pins and hooks are configured to resist this rotation and hold the rowing machine in its assembled configuration. The two beams are easily disconnected, however, simply by lifting up on the joint 18 and rotating the beams apart from each other.

For storage (FIG. 9), the monorail beam stands upright on its bracket end. The angle arm is pivoted around its bracket until the casters 29 rest on the floor. The angle arm may be moved around on the casters to a storage location and than rested on the flywheel/fan mechanism.

Other embodiments are within the scope of the following claims. For example, the foot restraint structure and the quick-release joint could be used in other exercise equipment, e.g., recumbent exercise bicycles.

What is claimed is:

1. A rowing machine comprising a frame, and a foot rest connected to the frame and having a base, a front end for applying a force against the upper front portion of a rower's foot for holding the front portion of the rower's foot adjacent a surface of the base, and a back end for cradling the heel of the rower's foot, said back end being pivotable relative to said front end, essentially independently of the force applied by the front end for holding the front portion of the rower's foot, said back end comprising a cross strap which resists said rower's foot from sliding backward relative to said front end, said cross strap defining a window for receiving the heel of said rower's shoe, so that said back end is pulled up by the heel of said rower's foot pushing against said cross strap.

2. A rowing machine comprising:

a frame having a seat and having handles that are movable relative to the frame, and a foot rest connected to the frame and having a front end for holding the foot portion of a rower's foot substantially fixed relative to said frame, and a back end for cradling the heel of the rower's foot, said front end and said back end being connected by a strap, said front end having a post and said strap having a series of holes along a portion of its length which fit over said post to fix the position of said back end relative to said front end, said back end being movable relative to said front end to permit the rower to pivot the heel of his foot relative to the front portion of his foot.

3. A rowing machine comprising:

a frame having a seat and having handles that are movable relative to the frame, and a foot rest connected to the frame and having a front end for holding the foot portion of a rower's foot substantially fixed relative to said frame, and a back end for cradling the heel of the rower's foot, said back end comprising a cross strap which resists said rower's foot from sliding backward relative to said front end, said cross strap defining a window for receiving the heel of said rower's shoe, so that said back end is pulled up by the heel of said exerciser's foot pushing against said cross strap, said back end being movable relative to said front end to permit the rower to pivot the heel of his foot relative to the front portion of his foot.

4. A rowing machine comprising:

a frame having a seat and having handles that are movable relative to the frame, and a foot rest connected to the frame and having a front end for holding the foot portion of a rower's foot, and a back end for cradling the heel of the rower's foot, said front end and said back end being connected by a strap, said front end having a post and said strap having a series of holes along a portion of its length which fit over said post to fix the position of said back end relative to said front end.

5. A rowing machine comprising:

a frame having a seat and having handles that are movable relative to the frame, and a foot rest connected to the frame and having a front end for holding the foot portion of a rower's foot, and a back end for cradling the heel of the rower's foot, said back end comprising a cross strap which resists said rower's foot from sliding backward relative to said front end, said cross strap defining a window for receiving the heel of said rower's shoe, so that said back end is pulled up by the heel of said exerciser's foot pushing against said cross strap.

6. The rowing machine of claim 1, 2, 3, 4, or 5 wherein said back end provides resistance to pivoting of said rower's heel.

7. The rowing machine of claim 1, or 5 wherein said front end and said back end are movable relative to each other to adjust for foot length.

8. The rowing machine of claim 3 or 5 wherein said front end and said back end are connected by a strap.

9. The rowing machine of claim 2 or 4 wherein said strap comprises a flexible material.

10. The rowing machine of claim 2 or 4 wherein said strap slides in a channel through said front end.

11. The rowing machine of claim 10 wherein said channel is defined at least in part by two side members of said front end.

12. The rowing machine of claim 2 or 4 wherein said front end has a protuberance which cooperates with a lip on said strap to resist said strap being withdrawn from said front end.

13. The rowing machine of claim 12 wherein said post helps position said lip to abut said protrusion.

14. The rowing machine of claim 2 or 4 wherein said post has an angled upper surface.

15. The rowing machine of claim 1, 2, 3, 4 or 5 wherein said front end is fixed relative to said frame.

16. The rowing machine of claim 1, 2, 3, 4 or 5 further comprising a strap to hold the front portion of said rower's foot against said front end.

17. The rowing machine of claim 1, 2, 3, 4 or 5 wherein said back end cradles said rower's heel against lateral movement.

18. The rowing machine of claim 1, 2, 3, 4 and 5 wherein said front end curves upward to hold the rower's toes angled upward.

* * * * *